US012000234B2

(12) United States Patent
Giordano

(10) Patent No.: US 12,000,234 B2
(45) Date of Patent: Jun. 4, 2024

(54) CEMENT PLUG SYSTEM

(71) Applicant: INNOVEX DOWNHOLE SOLUTIONS, INC., Houston, TX (US)

(72) Inventor: Steve Giordano, Houston, TX (US)

(73) Assignee: INNOVEX DOWNHOLE SOLUTIONS, INC., Houston, TX (US)

( * ) Notice: Subject to any disclaimer, the term of this patent is extended or adjusted under 35 U.S.C. 154(b) by 76 days.

(21) Appl. No.: 17/742,583

(22) Filed: May 12, 2022

(65) Prior Publication Data

US 2022/0364431 A1 Nov. 17, 2022

Related U.S. Application Data

(60) Provisional application No. 63/187,799, filed on May 12, 2021.

(51) Int. Cl.
*E21B 33/13* (2006.01)
*E21B 33/12* (2006.01)

(52) U.S. Cl.
CPC ..... *E21B 33/13* (2013.01); *E21B 33/12* (2013.01)

(58) Field of Classification Search
CPC ..... E21B 33/13; E21B 33/12; E21B 34/103
See application file for complete search history.

(56) References Cited

U.S. PATENT DOCUMENTS 4,624,312 A * 11/1986 McMullin ..... E21B 33/05 166/155
4,809,776 A * 3/1989 Bradley ..... E21B 33/16 166/291
5,234,052 A 8/1993 Coone et al.
5,413,172 A 5/1995 Laurel
5,722,491 A * 3/1998 Sullaway ..... E21B 33/165 166/291
5,829,523 A 11/1998 North
6,318,472 B1 * 11/2001 Rogers ..... E21B 33/16 166/212
9,200,499 B2 * 12/2015 Hall ..... E21B 33/16

FOREIGN PATENT DOCUMENTS

EP 2256288 A2 12/2010
WO 0066879 A1 11/2000

OTHER PUBLICATIONS

Park (Authorized Officer), International Search Report and Written Opinion dated Aug. 31, 2022, PCT Application No. PCT/US2022/028914, 11 pages.

* cited by examiner

*Primary Examiner* — Catherine Loikith

(74) *Attorney, Agent, or Firm* — MH2 TECHNOLOGY LAW GROUP, LLP

(57) ABSTRACT

A plug system includes a lower plug, an upper plug, and a sleeve configured to be positioned at least partially within the lower plug, the upper plug, or both. The sleeve defines one or more channels in an outer surface thereof. The sleeve is configured to shift axially from a first position into a second position with respect to the lower plug. In the first position, fluid is prevented from flowing through the one or more channels. In the second position, the fluid is permitted to flow through the lower plug via the one or more channels.

22 Claims, 15 Drawing Sheets

CEMENT PLUG SYSTEM

CROSS-REFERENCE TO RELATED APPLICATIONS

This application claims priority to U.S. Provisional Patent Application No. 63/187,799, filed on May 12, 2021, the entirety of which is incorporated by reference.

BACKGROUND

Plugs are used in oil and gas wells to separate a cement slurry from other fluids, reducing contamination and maintaining predictable slurry performance. One type of plug system is a subsea release plug, which typically includes two plugs: a first (e.g., bottom) plug and a second (e.g., top) plug. The bottom plug is launched ahead of the cement slurry to minimize contamination by fluids inside the casing prior to cementing. A diaphragm (e.g., burst disk) in the bottom plug ruptures to allow the cement slurry to pass through the bottom plug after the bottom plug reaches a landing collar. The top plug is then pushed downward into contact with the bottom plug after the cementing operation to prevent additional fluid from flowing through the bottom plug.

Sometimes the diaphragm only partially ruptures, which increases the duration of the cementing operation and can cause other issues, such as hydraulic hammering. Other times, the diaphragm may not rupture at all, which prevents the cementing operation from taking place. When this occurs, the subsea release plug may need to be pulled out of the well and repaired or replaced.

SUMMARY

Embodiments of the disclosure include a plug system that includes a lower plug, an upper plug, and a sleeve configured to be positioned at least partially within the lower plug, the upper plug, or both. The sleeve defines one or more channels in an outer surface thereof. The sleeve is configured to shift axially from a first position into a second position with respect to the lower plug. In the first position, fluid is prevented from flowing through the one or more channels. In the second position, the fluid is permitted to flow through the lower plug via the one or more channels.

Embodiments of the disclosure also include a plug system for performing a cementing operation in a well. The plug system includes a lower plug, an upper plug, and a sleeve coupled to the lower plug and the upper plug and received at least partially in both. The sleeve defines one or more channels extending axially along an outer surface thereof. The lower plug and the sleeve are configured to be separated from the upper plug in response to application of a first predetermined force to the sleeve, and the sleeve is configured to shift axially with respect to the lower plug in response to application of a second predetermined force to the sleeve, from a first position in which fluid flow through the lower plug via the one or more channels is blocked to a second position in which fluid flow through the lower plug is permitted via the one or more channels, the first predetermined force being less than the second predetermined force.

Embodiments of the disclosure further include a method for performing a cementing operation in a well. The method includes running a lower plug, an upper plug, and a sleeve into a well, and introducing a first impediment into the well. The first impediment passes through the upper plug and is received at least partially within the sleeve, and the sleeve is positioned at least partially within the lower plug, the upper plug, or both. The method also includes separating the lower plug and the sleeve from the upper plug in response to application of a first predetermined force to the first impediment and the sleeve. The sleeve is in a first position when the sleeve is separated from the upper plug, and wherein fluid flow through the lower plug via one or more channels in an outer surface of the sleeve is blocked when the sleeve is in the first position. The method also includes shifting the sleeve axially with respect to the lower plug from the first position to a second position in response to application of a second predetermined force to the first impediment and the sleeve. Fluid flow through the lower plug via the one or more channels is permitted when the sleeve is in the second position. The first predetermined force is less than the second predetermined force. The method further includes pumping a cement slurry through the upper plug and the lower plug when the sleeve is in the second position. the cement slurry flows through the lower plug via the one or more channels.

BRIEF DESCRIPTION OF THE DRAWINGS

The present disclosure may best be understood by referring to the following description and accompanying drawings that are used to illustrate embodiments of the invention. In the drawings.

DETAILED DESCRIPTION

Figure 1:
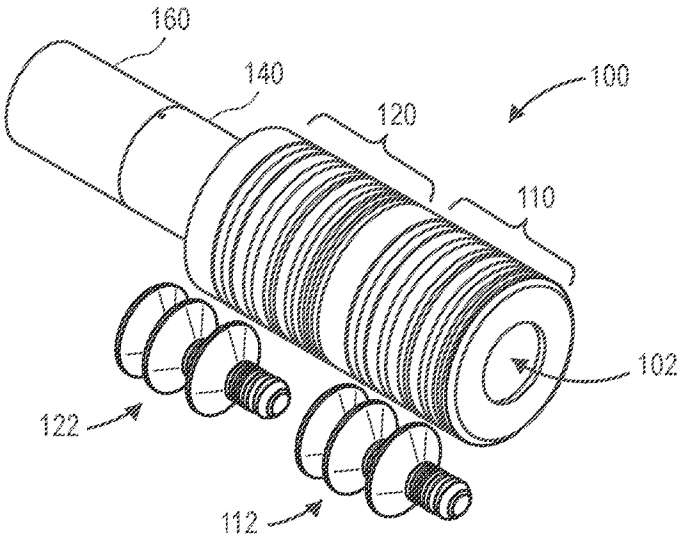
FIG. 1 illustrates a perspective view of a plug system in a run-in state, according to an embodiment.

The following disclosure describes several embodiments for implementing different features, structures, or functions of the invention. Embodiments of components, arrangements, and configurations are described below to simplify the present disclosure; however, these embodiments are provided merely as examples and are not intended to limit the scope of the invention. Additionally, the present disclosure may repeat reference characters (e.g., numerals) and/or letters in the various embodiments and across the Figures provided herein. This repetition is for the purpose of simplicity and clarity and does not in itself dictate a relationship between the various embodiments and/or configurations discussed in the Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the embodiments presented below may be combined in any combination of ways, e.g., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. In addition, unless otherwise provided herein, "or" statements are intended to be non-exclusive; for example, the statement "A or B" should be considered to mean "A, B, or both A and B."

The present disclosure is directed to a cement plug system that may be used in subsea cementing operations, for example. The plug system includes a first (e.g., lower) plug and a second (e.g., upper) plug. The plug system does not use or include a diaphragm (e.g., a rupture disk). Instead, the plug system includes a sliding sleeve that may slide between a first position and a second position. In the first position, fluid (e.g., a cement slurry) is prevented from flowing through the lower plug. In the second position, the fluid is permitted to flow through the lower plug.

FIG. 1 illustrates a perspective view of a cement plug system 100 in a first (e.g., run-in) state, according to an embodiment. The cement plug system 100 may be or include a subsea release plug, to name just one example. The cement plug system 100 may include a first (e.g., lower) plug 110 and a second (e.g., upper) plug 120. The cement plug system 100 may be configured to receive one or more impediments (two are shown: 112, 122). The impediments 112, 122 are shown outside of the cement plug system 100 in FIG. 1 for clarity. The impediments 112, 122 may be or include darts that may travel through a bore 102 of the cement plug system 100. The first impediment 112 may be configured to be received and retained at least partially within the lower plug 110, and the second impediment 122 may be configured to be received and retained at least partially within the upper plug 120. In one embodiment, the first impediment 112 may be smaller than the second impediment 122, which allows the first impediment 112 to pass through the upper plug 120.

The cement plug system 100 may also include or be coupled to a coupling (e.g., a pressure equalization latch coupling) 140 and a sub (e.g., a crossover sub) 160. More particularly, the upper plug 120 may be coupled to the coupling 140, and the coupling 140 may be coupled to the sub 160. The sub 160 may match the drill pipe connection for a running tool (not shown).

Figure 2A:
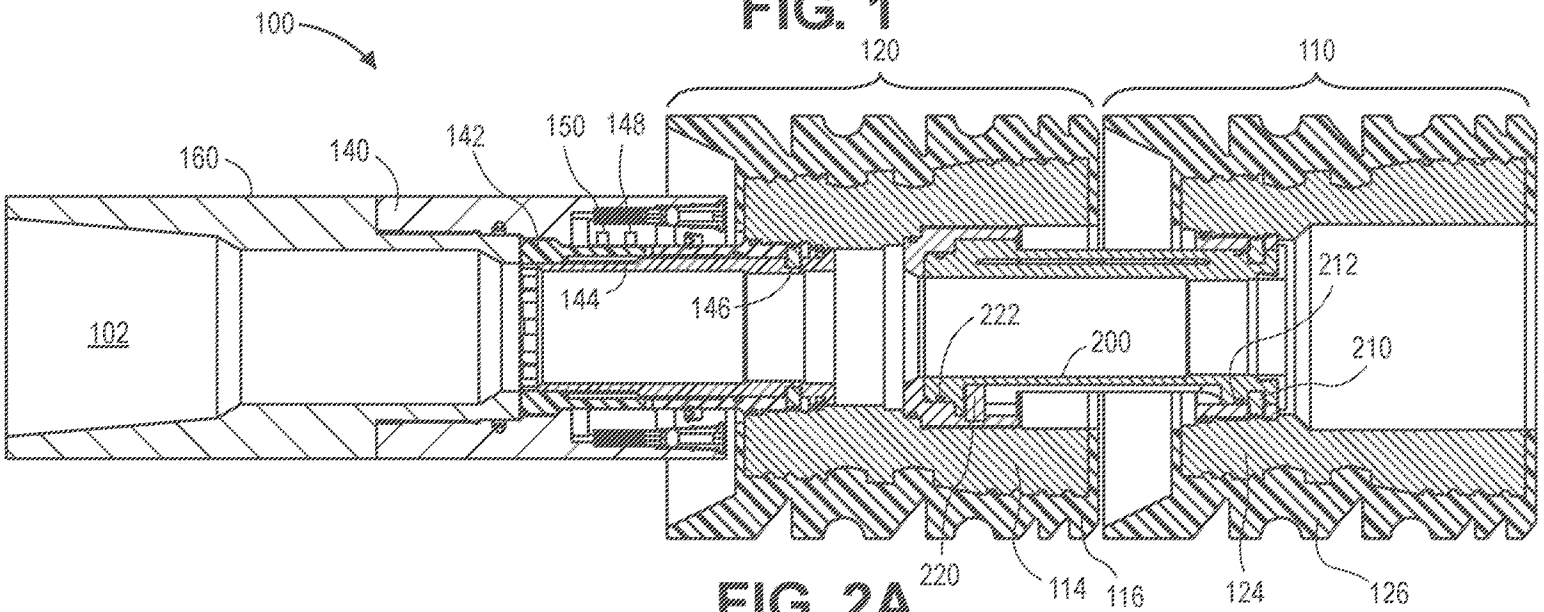
FIG. 2A illustrates a cross-sectional side view of the plug system in the run-in state, according to an embodiment.

FIG. 2A illustrates a cross-sectional side view of the cement plug system 100 in the run-in state, according to an embodiment. The plugs 110, 120 may each include a body 114, 124 and a sealing element (also referred to as wiping fin) 116, 126. The bodies 114, 124 may be positioned radially inward from the sealing elements 116, 126. The inner (e.g., radial) surfaces of the bodies 114, 124 may at least partially define the bore 102. The outer (e.g., radial) surfaces of the bodies 114, 124 may have profiles that correspond to the inner (e.g., radial) surfaces of the sealing elements 116, 126. Thus, in the embodiment shown in FIG. 2A, the outer surfaces of the bodies 114, 124 may (e.g., directly) contact the inner surfaces of the sealing elements 116, 126. The outer (e.g., radial) surfaces of the sealing elements 116, 126 may be configured to contact the inner (e.g., radial) surface of a tubular member, which may be or include a liner, a casing, a wall of a well, or the like.

The cement plug system 100 may include an annular sleeve 200, which may be positioned at least partially within the lower plug 110 and/or the upper plug 120. When the cement plug system 100 is in the run-in state, the sleeve 200 may be coupled to the lower plug 110 via one or more first (e.g., lower) shear members 210, and coupled to the upper plug 120 via one or more second (e.g., upper) shear members 220.

The sleeve 200 may be in a first position when the sleeve 200 is coupled to the lower plug 110 via the lower shear members 210. When the sleeve 200 is in the first position, one or more seals 212 positioned on or around the sleeve 200 may contact an inner surface of the lower plug 110, which may prevent fluid flow therepast (e.g., to the left and/or right as shown in FIG. 2A), in the small annulus between the lower plug 110 and the sleeve 200. When the sleeve 200 is coupled to the upper plug 120, one or more seals 222 positioned on or around the sleeve 200 may contact an inner surface of the upper plug 120, which may prevent fluid flow therepast (e.g., to the left and/or right as shown in FIG. 2A), in the small annulus between the upper plug 120 and the sleeve 200. The seals 212, 222 may be or include elastomeric O-rings.

The upper shear members 220 may be configured to shear in response to a first predetermined force, thereby de-coupling the sleeve 200 from the upper plug 120. The lower shear members 210 may be configured to shear in response to a second predetermined force, thereby de-coupling the sleeve 200 from the lower plug 120. The first predetermined force may be different (e.g., less than) the second predetermined force. As a result, the sleeve 200 may be de-coupled from the upper plug 120 before the sleeve 200 is de-coupled from the lower plug 110 during operation, as will be described in greater detail below. The predetermined forces may be axial forces, radial forces, rotational forces, or a combination thereof.

Also shown in FIG. 2A, the upper plug 120 may be coupled to the coupling 140 via an internal latch collet 142. The internal latch collet 142 may prevent the upper plug 120 from releasing from the coupling 140 until after the lower plug 110 is released from the upper plug 120. The internal latch collet 142 may be configured to actuate (e.g., shift radially) from a first (e.g., radially outward) position into a second (e.g., radially inward) position. In the radially outward position, the internal latch collet 142 couples the upper plug 120 to the coupling 140. In the radial inward position, the internal latch collet 142 de-couples the upper plug 120 from the coupling 140. More particularly, in the radial inward position, the internal latch collet 142 bends radially inward and de-couples from the coupling 140 such that the upper plug 120 and the internal latch collet 142 are free to move away from the coupling 140 (e.g., down the well).

An internal locking sleeve 144 may be positioned at least partially within the internal latch collet 142. The internal locking sleeve 144 may be configured to actuate (e.g., shift at least partially in an axial direction) from a first (e.g., locking) position into a second (e.g., unlocking) position. In the locking position, the internal locking sleeve 144 locks the internal latch collet 142 in the radially outward position. The internal locking sleeve 144 may shift axially within the internal latch collet 142 when shifting from the locking position into the unlocking position. When in the unlocking position, the internal locking sleeve 144 may be at least partially axially offset from the internal latch collet 142, which allows the internal latch collet 142 to shift into its radially inward position, thereby de-coupling the internal latch collet 142 and the upper plug 120 from the coupling 140 such that the upper plug 120, the internal latch collet 142, and the internal locking sleeve are free to move away from the coupling 140 (e.g., down the well).

The internal locking sleeve 144 may be coupled to the internal latch collet 142 via one or more shear members 146. The shear members 146 may be configured to shear at least partially in response to the second impediment 122 being received at least partially in or on the upper plug 120, the internal locking sleeve 144, or both. The shear members 146, 210, 220 may be selected or adjusted to permit shearing at specific, repeatable pressures.

The coupling 140 may include an internal dynamic lip seal 148 that is configured to allow rotation of the lower plug 110 and/or the upper plug 120 without causing damage to and/or premature shearing of the shear members 146, 210, 220. The coupling 140 may also include one or more pressure equalization ports 150 that are configured to prevent pressure from building up above the lower plug 110 and/or the upper plug 120, which could cause premature shearing of the shear members 146, 210, 220 and/or releasing of the plugs 110, 120.

Figure 2B:
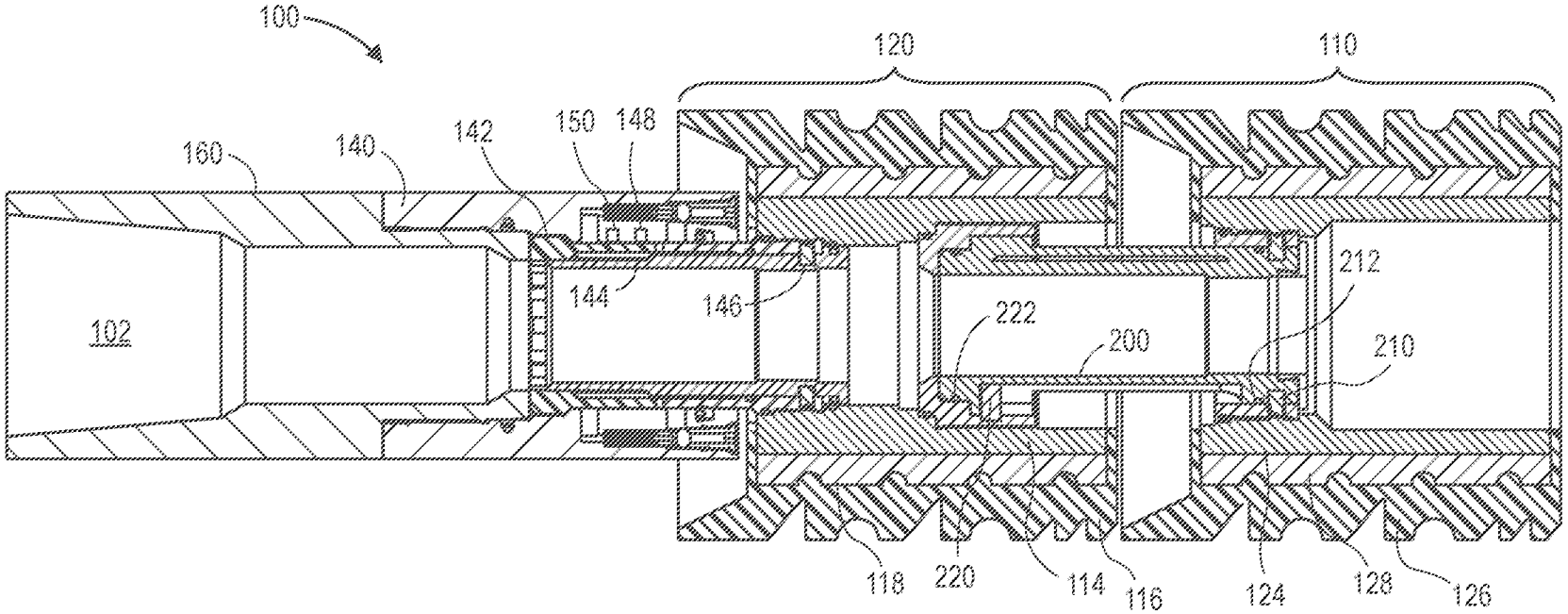
FIG. 2B illustrates a cross-sectional side view of the plug system in the run-in state including an adapter, according to an embodiment.

FIG. 2B illustrates a cross-sectional side view of the plug system 100 in the run-in state including one or more adapters (two are shown: 118, 128), according to an embodiment. The embodiment shown in FIG. 2B is substantially the same as the embodiment shown in FIG. 2A, except that the plug 110 shown in FIG. 2B also includes the adapter 118 positioned (e.g., radially) between the body 114 and the sealing element (also referred to as wiping fin) 116, and the plug 120 shown in FIG. 2B also includes the adapter 128 positioned (e.g., radially) between the body 124 and the sealing element 126. The outer surfaces of the bodies 114, 124 and/or the inner surfaces of the adapters 118, 128 may be substantially smooth and/or cylindrical. In one embodiment, the outer surfaces of the adapters 118, 128 and/or the inner surfaces of the sealing elements 116, 126 may be substantially smooth and/or cylindrical. However, in the embodiment shown, the outer surfaces of the adapters 118, 128 may include grooves, and the inner surfaces of the sealing elements 116, 126 may include protrusions, or vice versa, to couple the sealing elements 116, 126 to the adapters 118, 128.

In one embodiment, the plugs 110, 120 may be configured to use adapters 118, 128 and/or sealing elements 116, 126 of different sizes (e.g., diameters). For example, the outer surfaces of the adapters 118, 128 and/or the inner surfaces of the sealing elements 116, 126 shown in FIG. 2B may have a first diameter (e.g., 4 inches), and the outer surfaces of the sealing elements 116, 126 may have a second diameter (e.g., 5 inches). If plugs 110, 120 of a different size (e.g., diameter) are desired, the adapters 118, 128 and/or the sealing elements 116, 126 may be replaced with different adapters 118, 128 and/or different sealing elements 116, 126. For example, the outer surfaces of the different adapters and/or the inner surfaces of the different sealing elements may have a third diameter (e.g., 5 inches), and the outer surfaces of the different sealing elements may have a fourth diameter (e.g., 6 inches). Thus, the adapters 118, 128 may allow the plugs 110, 120 and/or the sealing elements 116, 126 to be modular.

In addition, in one embodiment, the plug 110 and/or the plug 120 may have a sealing and/or non-rotating profile. In another embodiment, the plug 110 and/or the plug 120 may be configured to receive or include a threaded sealing, latch-in feature.

Figure 3:
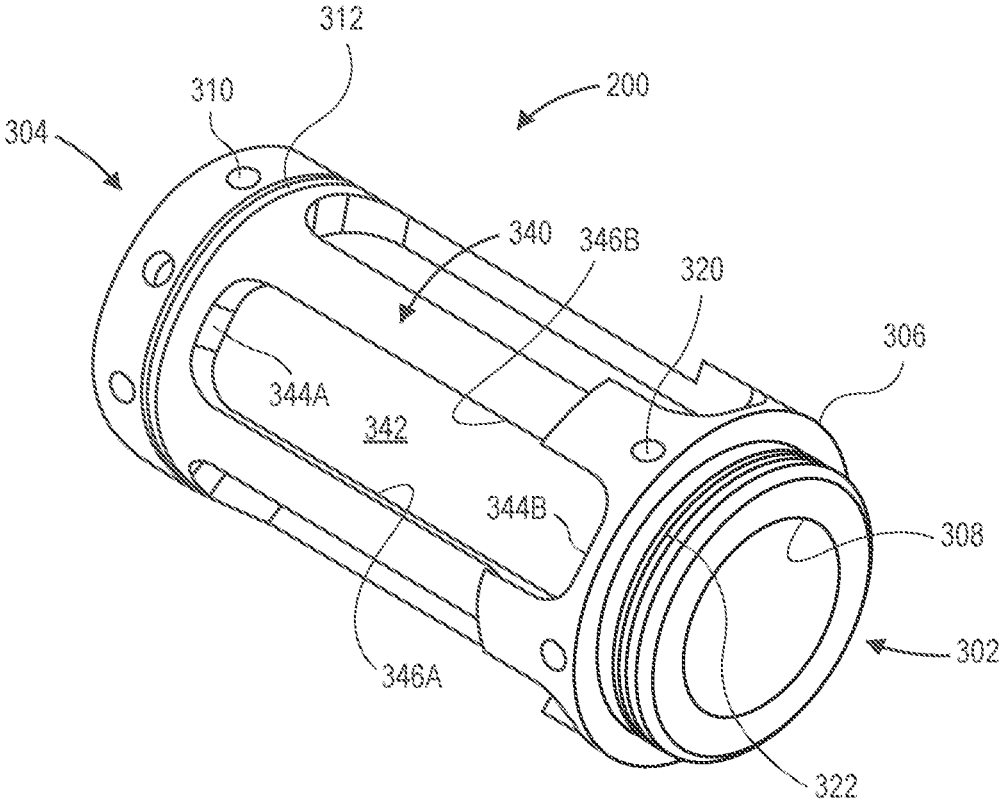
FIG. 3 illustrates a perspective view of a sleeve that may be positioned at least partially within the plug system, according to an embodiment.
Figure 4:
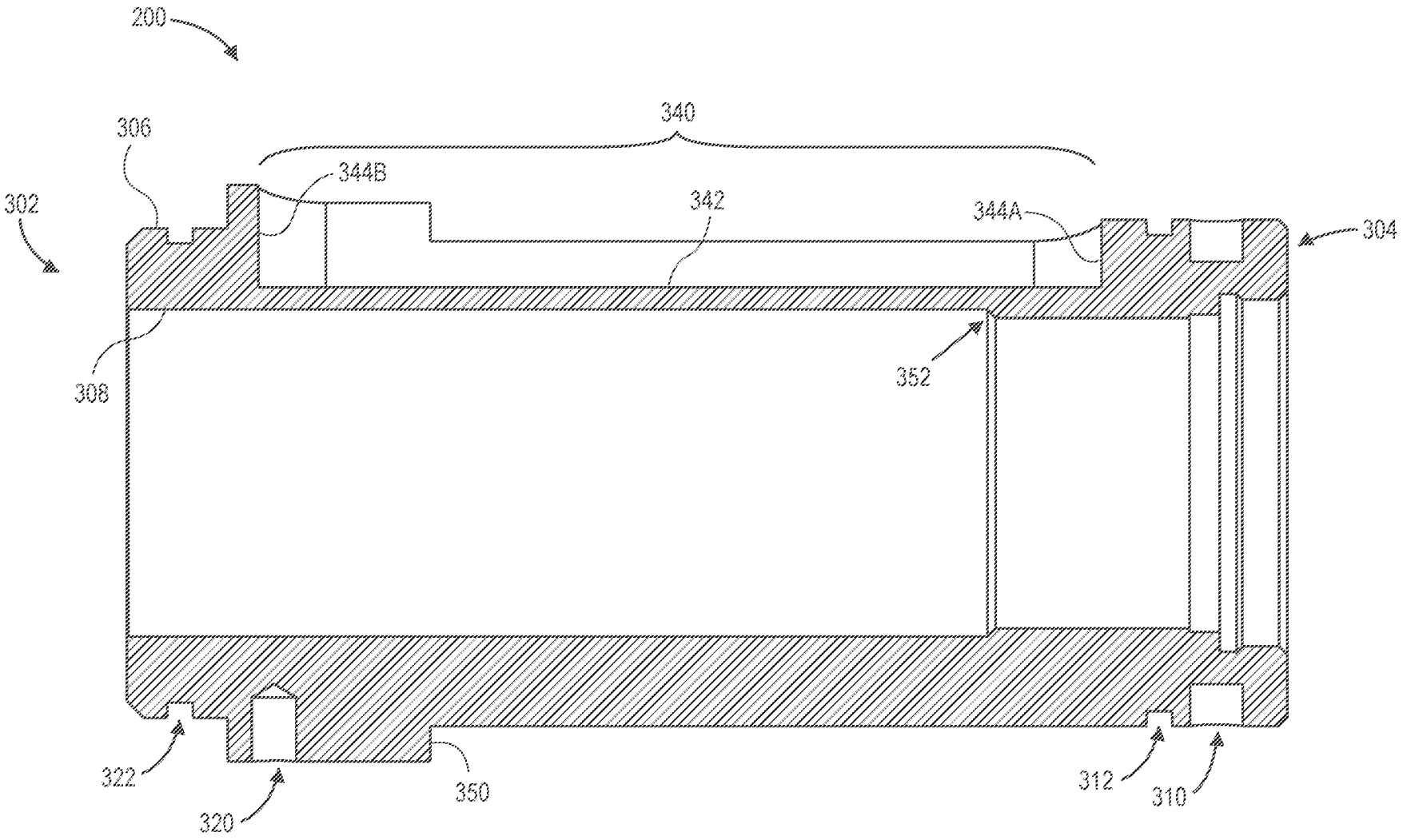
FIG. 4 illustrates a cross-sectional side view of the sleeve, according to an embodiment.

FIG. 3 illustrates a perspective view of the sleeve 200, and FIG. 4 illustrates a cross-sectional side view of the sleeve 200, according to an embodiment. The sleeve 200 may include a first (e.g., upper) end 302, a second (e.g., lower) end 304, and outer surface 306, and an inner surface 308. The outer surface 306 may include or define one or more first (e.g., upper) recesses 320 proximate to the upper end 302 that are configured to receive the upper shear members 220 at least partially therein. The outer surface 306 may also include or define one or more second (e.g., lower) recesses 310 proximate to the lower end 304 that are configured to receive the lower shear members 210 at least partially therein. In an embodiment, the upper recesses 320 and the corresponding upper shear members 220 may have a lesser thickness (e.g., diameter) than the lower recesses 310 and the corresponding lower shear members 210, which may facilitate the upper shear members 220 shearing in response to a lesser force than the lower shear members 210. In some embodiments, the number of the upper recesses 320 and the corresponding upper shear members 220 may be less than the number of the lower recesses 310 and the corresponding lower shear members 210, which may also facilitate the upper shear members 220 shearing in response to a lesser force than the lower shear members 210.

The outer surface 306 may also include or define one or more axial channels 340. As shown, a plurality of channels 340 may be circumferentially offset from one another around the sleeve 200. The channels 340 may be recessed in the outer surface 306. In other words, each channel 340 may be defined at least partially by a base surface 342, opposing end walls 344A, 344B, and opposing side walls 346A, 346B. The size and/or number of channels 340 may be selected to be equivalent to a diaphragm through the cement plug system 100. As a result, a conventional diaphragm may be omitted from the cement plug system 100. In addition, the flowpath area through the channels 340 may be adjusted or selected by changing number of and/or the geometry (e.g., size) of the channels 340. Thus, when the lower shear pins 210 shear and the sleeve 200 shifts into its second position, this may provide a full flow path through the channels 340. The sleeve 200 may actuate by shifting axially and/or rotating.

The outer surface 306 may also include or define one or more seal recesses (two are shown: 312, 322) configured to have the seal(s) 212, 222 positioned at least partially therein. As mentioned above, when the cement plug system 100 is in the run-in state, the seal 212 may contact an inner surface of the lower plug 110, which may prevent fluid flow between the lower plug 110 and the sleeve 200. In addition, when the cement plug system 100 is in the run-in state, the seal 222 may contact an inner surface of the upper plug 120, which may prevent fluid flow between the upper plug 120 and the sleeve 200. Thus, the seals 212, 222 may prevent fluid flow through the channels 340 when the cement plug system 100 is in the run-in state.

The sleeve 200 may be in the first position when the cement plug system 100 is in the run-in state. Thus, the seals 212, 222 may prevent fluid flow through the channels 340 when the sleeve 200 is in the first position. However, the seal 212 may be spaced apart from the inner surface of the lower plug 110 when the sleeve 200 is in the second position. As a result, the channels 340 may provide a flow path through which fluid (e.g., cement slurry) may flow when the sleeve 200 is in the second position.

The outer surface 306 may include an outer shoulder 350. The outer shoulder 350 may extend past the upper-most part of the channels 340, so that it is configured to keep part of the channels 340 exposed above the lower plug 110. In one embodiment, the outer shoulder 350 may be configured to contact the inner surface of the lower plug 110 when the sleeve 200 actuates from the first position into the second position. The contact may prevent the 200 sleeve 200 from passing all the way through the lower plug 110. The upper shear members 220 may be positioned circumferentially between the channels 340 and/or on the outer shoulder 350.

The inner surface 308 may include an inner shoulder 352. The cross-sectional width (e.g., diameter) of the inner shoulder 352 may decrease proceeding in a direction from the upper end 302 toward the lower end 304. In one embodiment, the inner shoulder 352 may be configured to serve as a seat to receive the first impediment 112 (FIG. 1).

Figure 5:
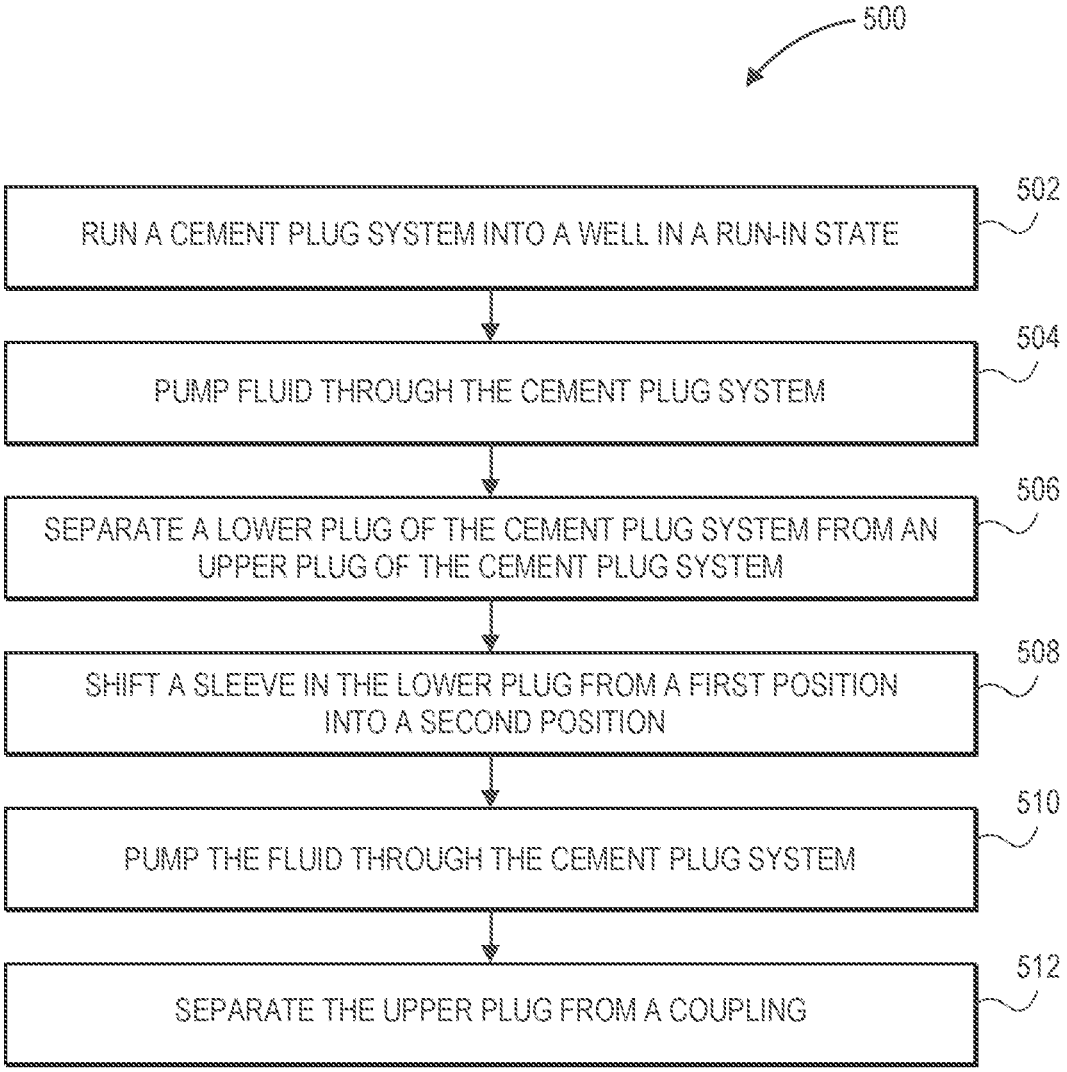
FIG. 5 illustrates a flowchart of a method for performing a cementing operation in a well using a plug system, according to an embodiment.

FIG. 5 illustrates a flowchart of a method 500 for performing a cementing operation in a well using the cement plug system 100, according to an embodiment. An illustrative order of the method 500 is described below; however, one or more steps of the method 500 may be performed in a different order, performed simultaneously, separated, condensed into a single step, repeated, or omitted, without departing from the scope of the present disclosure.

Figure 6:
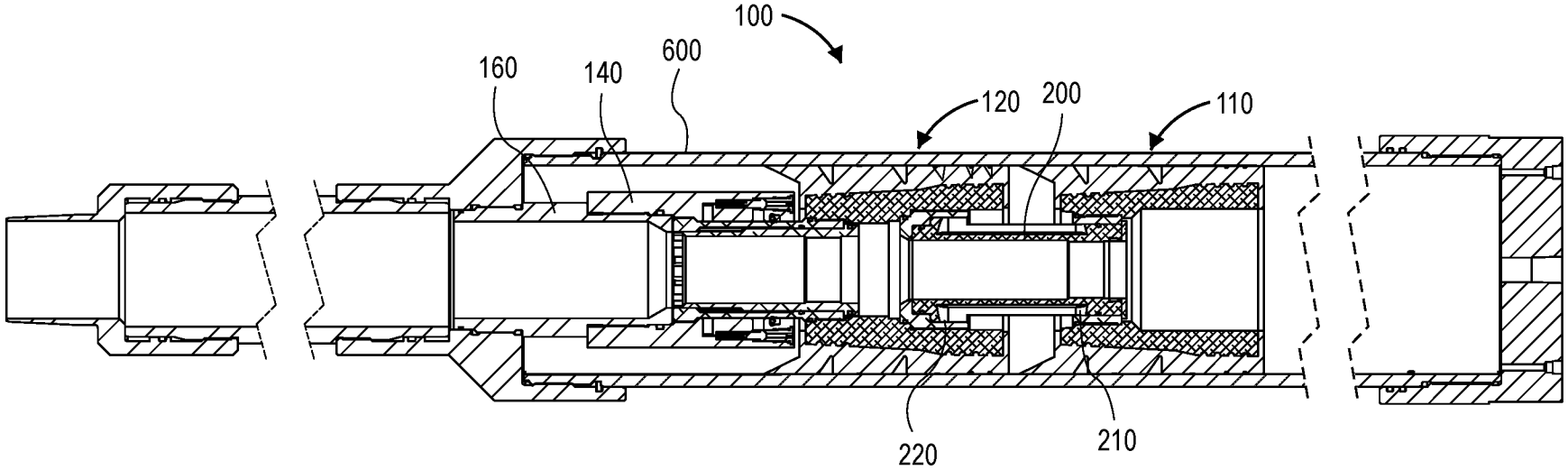
FIG. 6 illustrates a cross-sectional side view of the plug system being run into the well while in the run-in state, according to an embodiment.

The cement plug system 100 may be run into a well in the run-in state, as at 502. This is illustrated in FIG. 6. More particularly, the cement plug system 100 may be run into a tubular member 600 in the well. The tubular member 600 may be or include a wall of the well, a casing, a liner, a riser, or a combination thereof. As mentioned above, when the cement plug system 100 is in the run-in state, the lower plug 110 may be coupled to the upper plug 120 (e.g., via the sleeve 200), the upper plug 120 may be coupled to the coupling 140, and the sleeve 200 may be in the first position such that fluid flow between the lower plug 110 and the sleeve 200 is blocked. In addition, when the cement plug system 100 is in the run-in state, the bore 102 may be unobstructed, which may allow for circulation therethrough, as described below.

Fluid may be pumped through the cement plug system 100, as at 504. Once the cement plug system 100 is in the desired location within the well, fluid may be pumped down the well from the surface (e.g., using a pump at the surface). The fluid may circulate through the bore 102 of the cement plug system 100. In other words, the fluid may flow through the plugs 110, 120, the coupling 140, and the sub 160. The fluid may be or include water, drilling fluid, cement slurry, or a combination thereof.

Figure 7:
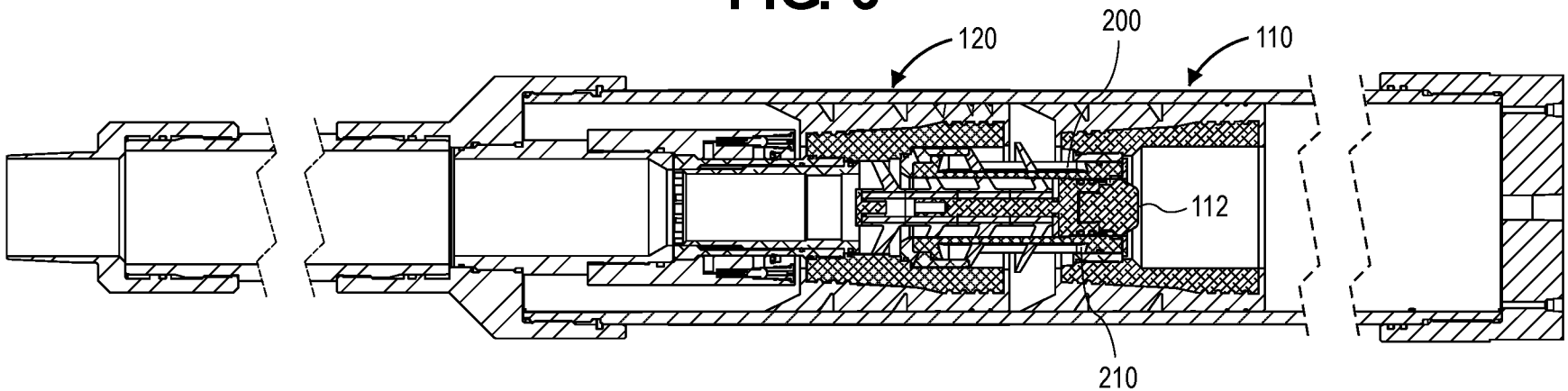
FIG. 7 illustrates a cross-sectional side view of a first (e.g., lower) dart received within a first (e.g., lower) plug of the plug system, according to an embodiment.

The lower plug 110 may separate from the upper plug 120, as at 506. This may include introducing the first impediment (e.g., dart) 112 into the well, and continuing to pump fluid above the first impediment 112 into the well, which pushes the first impediment 112 toward the cement plug system 100. The first impediment 112 may be received at least partially within the lower plug 110, the upper plug 120, the sleeve 200, or a combination thereof. This is shown in FIG. 7. More particularly, the first impediment 112 may pass through the upper plug 120 and be received on the upper end 302 of the sleeve 200 and/or on the shoulder 352 in the sleeve 200.

Once the first impediment 112 is received, it may prevent fluid flow through the lower plug 110 and/or the sleeve 200. Thus, the continued pumping of fluid in the well may increase a force exerted on the lower plug 110, the first impediment 112, and/or the sleeve 200. Once the force reaches the first predetermined threshold, the upper shear members 220, but not the lower shear members 210, may shear, thereby releasing the sleeve 200 from the upper plug 120. The lower plug 110, the first impediment 112, and the sleeve 200 may thus move downward in the well, away from the still-stationary upper plug 120.

Figure 8:
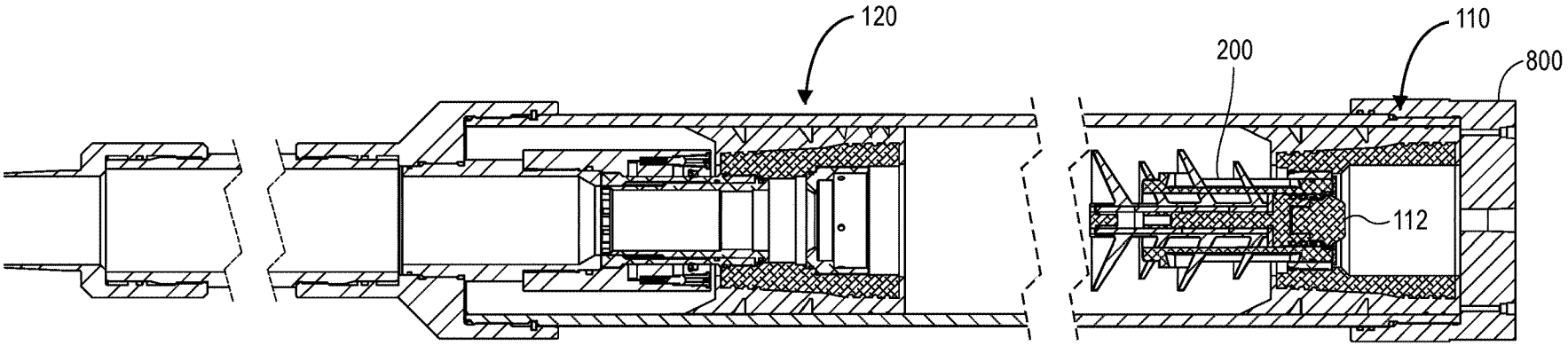
FIG. 8 illustrates a cross-sectional side view of the lower plug released and separated from a second (upper) plug of the plug system, according to an embodiment.

The lower plug 110 may land on a float collar 800. This is shown in FIG. 8. At the time that the lower plug 110 lands on the float collar 800, the sleeve 200 may still be in the first position (e.g., coupled to the lower plug 110 via the lower shear members 210), and the lower impediment 112, the sleeve 200, and the seal 212 may prevent fluid flow through the lower plug 110. More particularly, when the sleeve 200 is in the first position, the seal 212 may prevent fluid from flowing between the lower plug 120 and the sleeve 200 via the channels 340.

Figure 9A:
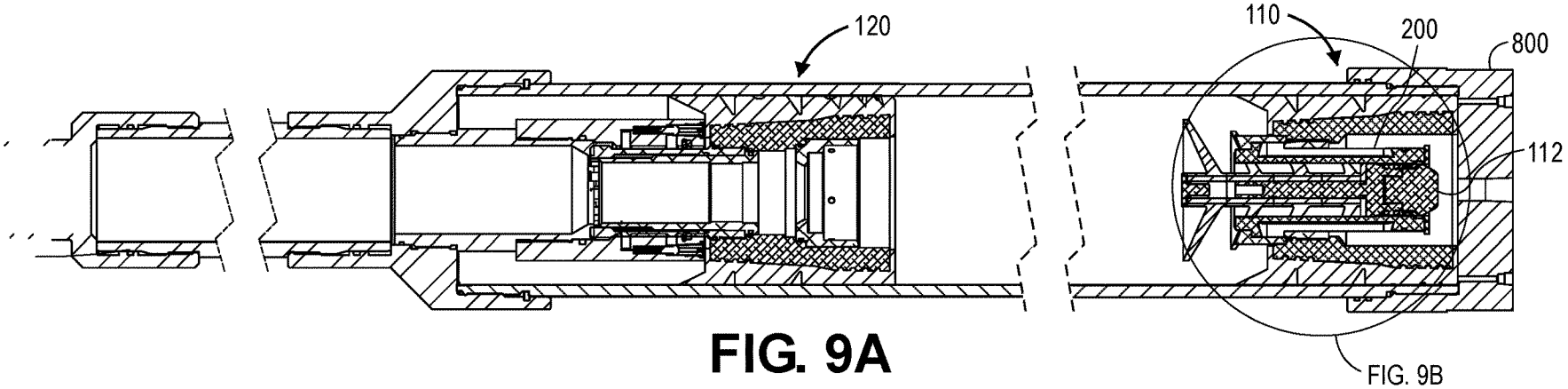
FIG. 9A illustrates a cross-sectional side view of the sleeve shifted from a first position to a second position in the lower plug, according to an embodiment.
Figure 9B:
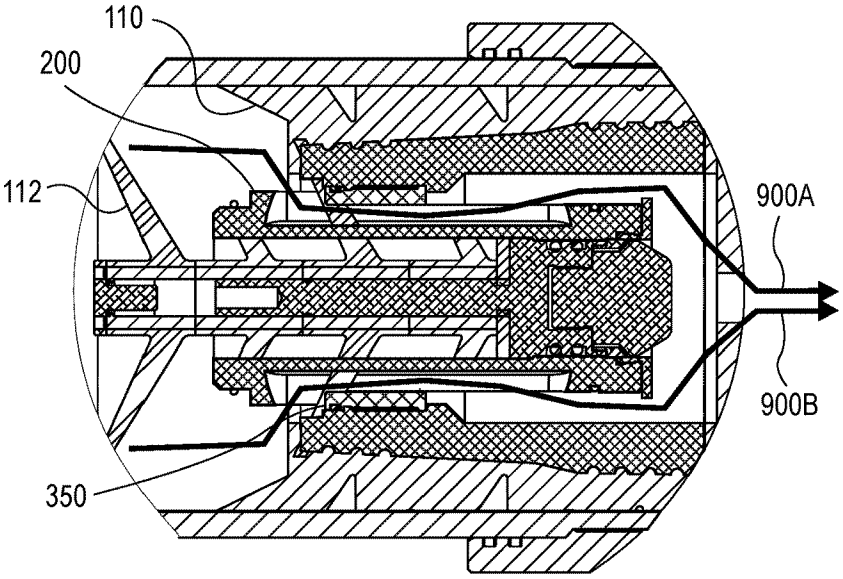
FIG. 9B illustrates an enlarged portion of FIG. 9A, showing a cement flow path through the lower plug, according to an embodiment.

The sleeve 200 may shift from the first position into the second position, as at 508. The continued pumping of the fluid in the well may increase the force exerted on the first impediment 112 and the sleeve 200. Once the force reaches the second predetermined threshold, which is greater than the first threshold, the lower shear members 210 may shear, allowing the sleeve 200 to shift from the first position into the second position. This is shown in FIGS. 9A and 9B. When the sleeve 200 shifts from the first position into the second position, the sleeve 200 moves farther away from the upper plug 120 (e.g., to the right in FIGS. 9A and 9B). The outer shoulder 350 of the sleeve 200 may contact the inner surface of the lower plug 110 when the sleeve 200 is in the second position. This may prevent further downward movement of the sleeve 200 with respect to the lower plug 110.

The fluid may be pumped through the cement plug system 100, as at 510. In this step, the fluid may be or include a cement slurry. Thus, this step may also or instead include performing a cementing operation by pumping the cement slurry through the cement plug system 100. The cement slurry may flow through the upper plug 120 toward the lower plug 110. When the sleeve 200 is in the second position, cement slurry may flow through the lower plug 110 (e.g., between the lower plug 110 and the sleeve 200). More particularly, the cement slurry may flow in the flowpath(s) 900A, 900B through the channels 340 in the sleeve 200, as shown in FIG. 9B.

Once the cementing operation is complete, the upper plug 120 may separate from the coupling 140, as at 512. This may include introducing the second impediment (e.g., dart) 122 into the well, and pumping fluid above the second impediment 122 into the well, which pushes the second impediment 122 toward the cement plug system 100. The second impediment 122 may be received at least partially within the upper plug 120 and/or the internal locking sleeve 144. This is shown in FIG. 10.

Figure 10:
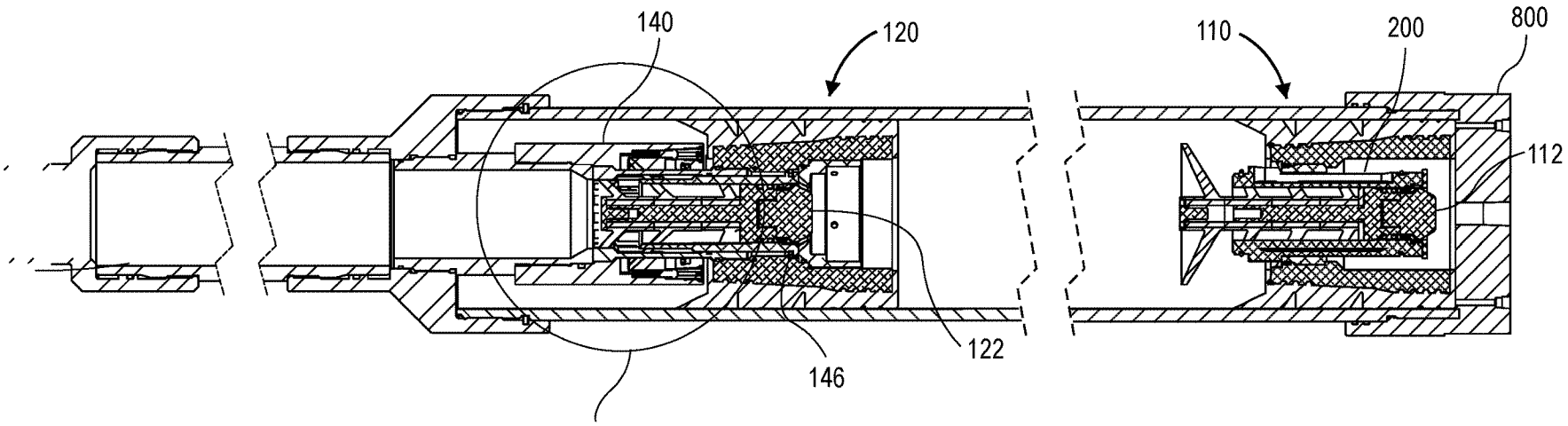
FIG. 10 illustrates a cross-sectional side view of a second (e.g., upper) dart received within the upper plug, according to an embodiment.
Figure 11B:
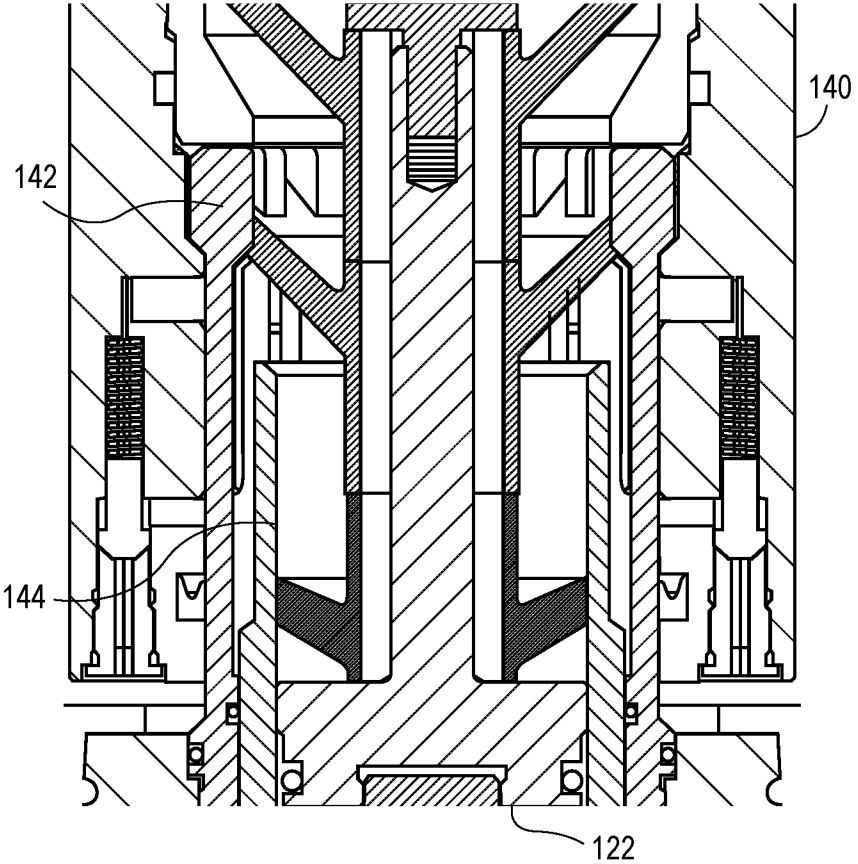
FIG. 11B illustrates a cross-sectional side view of the upper plug released and separated from the coupling, according to an embodiment.
Figure 11A:
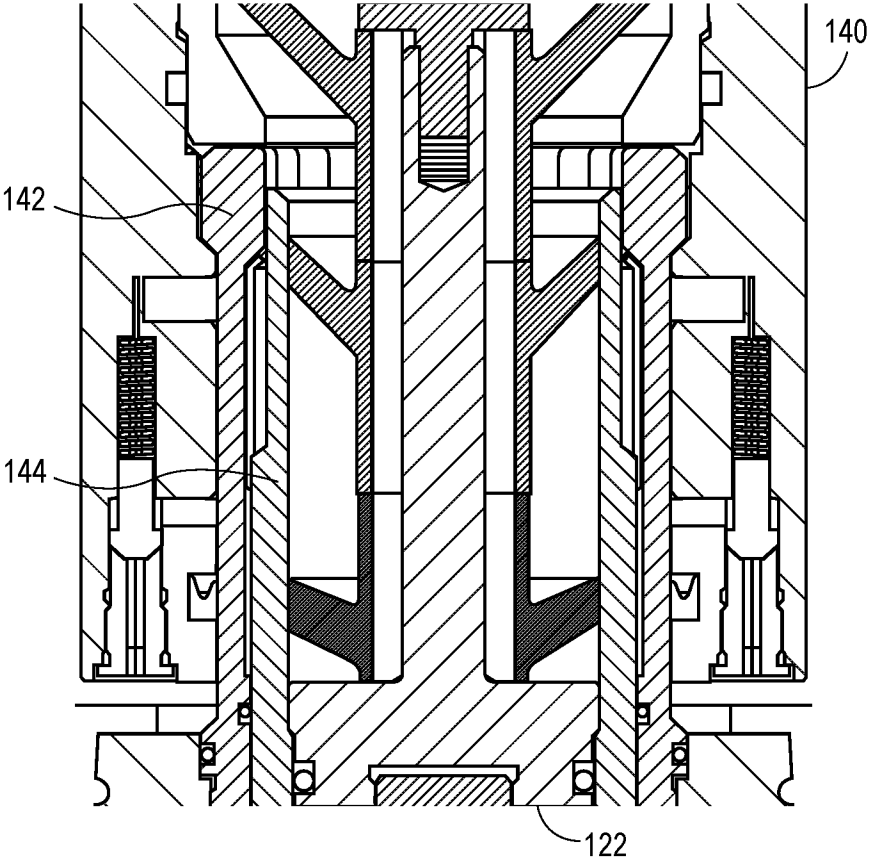
FIG. 11A illustrates a cross-sectional side view of the upper plug coupled to a coupling, according to an embodiment.

FIG. 11A illustrates an enlarged cross-sectional side view of a portion of FIG. 10, according to an embodiment. As mentioned above, the internal latch collet 142 couples the upper plug 120 to the coupling 140. Once the second impediment 122 is received at least partially within the upper plug 120 and/or the internal locking sleeve 144, it may prevent fluid flow through the upper plug 120. Continued pumping of fluid into the well may cause a force exerted on the upper plug 120, the second impediment 122, and/or the internal locking sleeve 144 to increase. The force may increase until the shear members 146 (FIG. 2A) shear, allowing the second impediment 122 and the internal locking sleeve 144 to shift downward with respect to the upper plug 120 and/or the internal latch collet 142, as shown in FIG. 11B. When the internal locking sleeve 144 shifts, the internal latch collet 142 may have a clearance to bend radially inwards, which de-couples the upper plug 120 from the coupling 140.

Figure 12:
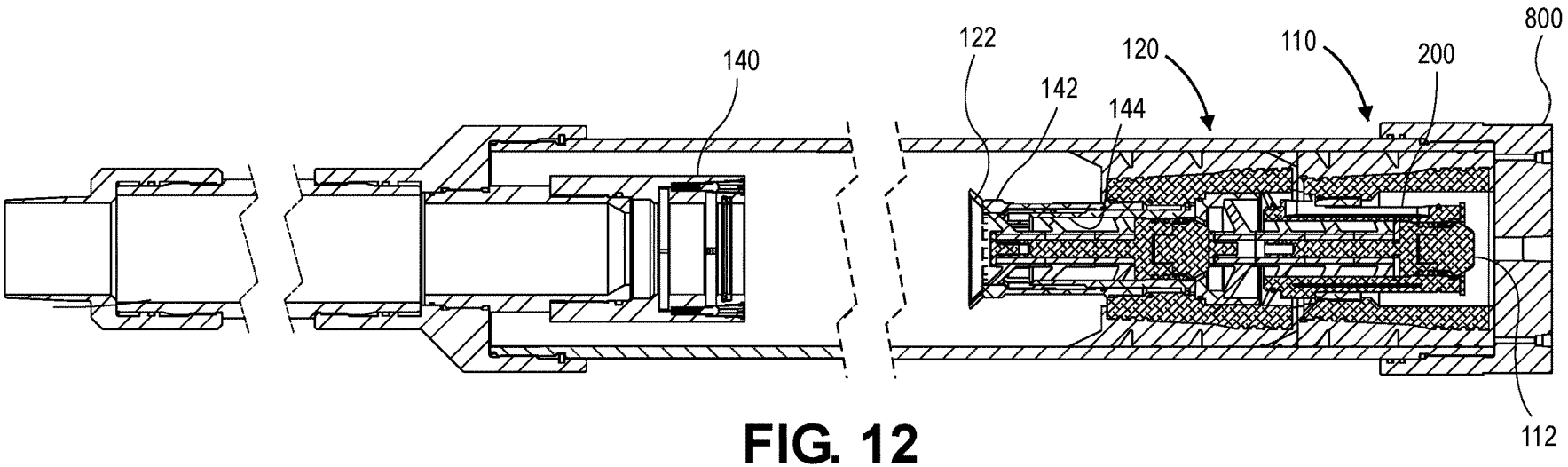
FIG. 12 illustrates a cross-sectional side view of the upper plug once again in contact with the lower plug, according to an embodiment.

The upper plug 120, the second impediment 122, the internal latch collet 142, the internal locking sleeve 144, or a combination thereof may then move downward in the well, toward the lower plug 110. The upper plug 120 and/or the second impediment 122 may then contact the lower plug 110, the first impediment 122, and/or the sleeve 200. This is shown in FIG. 12. The second impediment 122 may still prevent fluid from flowing through the upper plug 120, which may prevent fluid from flowing through the lower plug 120 and/or the sleeve 200. In other words, when the upper plug 120 lands on and seals with the lower plug 110, this may close off fluid flow through the channels 340 in the sleeve 200. The method 500 may then be complete.

Figure 13:
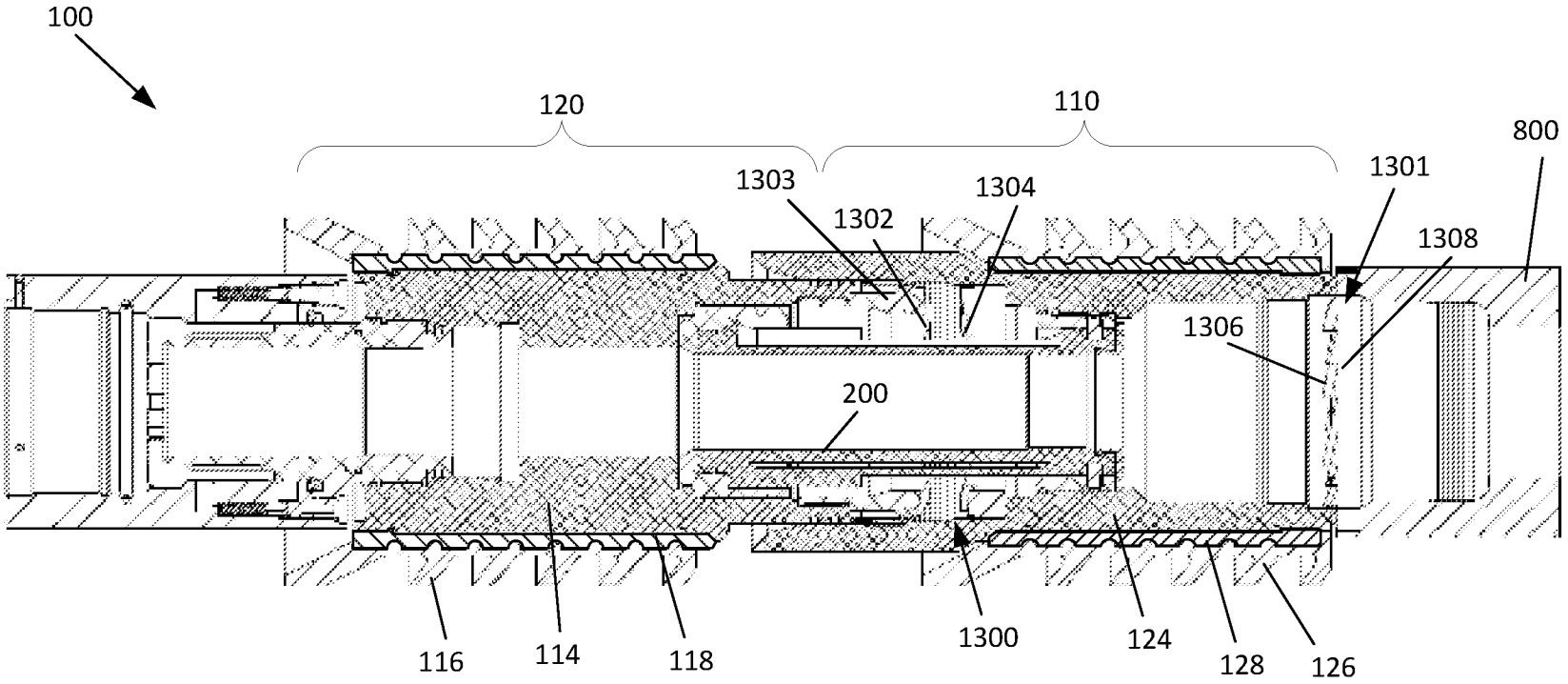
FIG. 13 illustrates a cross-sectional side view of the plug system, according to another embodiment.

FIG. 13 illustrates a cross-sectional side view of the plug system 100, according to another embodiment. This embodiment of the plug system 100 may be similar to the embodiment of FIG. 2B, e.g., including a modular design of the lower and upper plugs 110, 120 implementing the adapters 118, 128 between the bodies 114, 124 and the sealing elements 116, 126, with the adapter sleeve 200 positioned therebetween. Additionally, the plug system 100 may include one or more anti-rotation features that prevent relative rotation between the upper plug 120 and the lower plug 110, between the lower plug 110 and the float collar 800, or both.

Specifically, in this embodiment, the plug system 100 includes a first anti-rotation feature 1300 that is configured to prevent relative rotation between the upper plug 120 and the lower plug 110, and a second anti-rotation feature 1301 that is configured to prevent relative rotation between the lower plug 110 and the float collar 800. The first anti-rotation feature 1300 may, in at least some embodiments, be configured to prevent rotation in one circumferential direction, but not the opposite circumferential direction. For example, a drill-out direction may be anticipated, and the first anti-rotation feature 1300 may be configured to resist rotation of the upper plug 120 in the drill-out direction relative to the lower plug 110, e.g., to support drill-out operations. In other embodiments, the first anti-rotation feature 1300 may resist rotation in both directions.

In a specific embodiment, the first anti-rotation feature 1300 may include teeth 1302 formed at a lower end of the upper plug 120 or on an extension body 1303 extending therefrom, as shown. The teeth 1302 may be positioned around the annular sleeve 200. The first anti-rotation feature 1300 may also include teeth 1304 formed at an upper end of the lower plug 110 and positioned around the annular sleeve 200. The teeth 1302, 1304 may initially be separated axially apart, but may move into engagement with one another, e.g., after the bottom plug 110 lands on the float collar 800, the adapter sleeve 200 is shifted downward, and the upper plug 110 lands on the lower plug 120, as described above. The teeth 1302, 1304 may be tapered, such that the teeth 1302, 1304 meshing resist relative rotation in at least one circumferential direction.

The second anti-rotation feature 1301 may, in at least some embodiments, be configured to prevent rotation in one circumferential direction, but not the opposite circumferential direction. For example, a drill-out direction may be anticipated, and the second anti-rotation feature 1301 configured to resist rotation of the lower plug 110 in the drill-out direction relative to the float collar 800, e.g., to support drill-out operations. In other embodiments, the second anti-rotation feature 1301 may resist rotation in both directions.

The second anti-rotation feature 1301 may include teeth 1306 connected or formed by the lower plug 110, and teeth 1308 formed at the upper end of the float collar 800. For example, the teeth 1308 of the float collar 800 may be provided as an insert that is connected to the float collar 800. The insert may be annular, so as to permit fluid flow therethrough. The teeth 1306, 1308 may mesh together when the bottom plug 110 lands on the float collar 800. The teeth 1306, 1308 may be tapered and/or otherwise configured to resist rotation of the lower plug 110 relative to the float collar 800 in at least one circumferential direction.

Accordingly, once the lower plug 120 lands on the float collar 800 and the upper plug 110 lands on the lower plug 120, the plug system 100 may be configured to resist internal rotation between its elements by operation of the first and second anti-rotation features 1300, 1301. This may facilitate drill-out operations by avoiding the components rotating with the drill bit.

Figure 14:
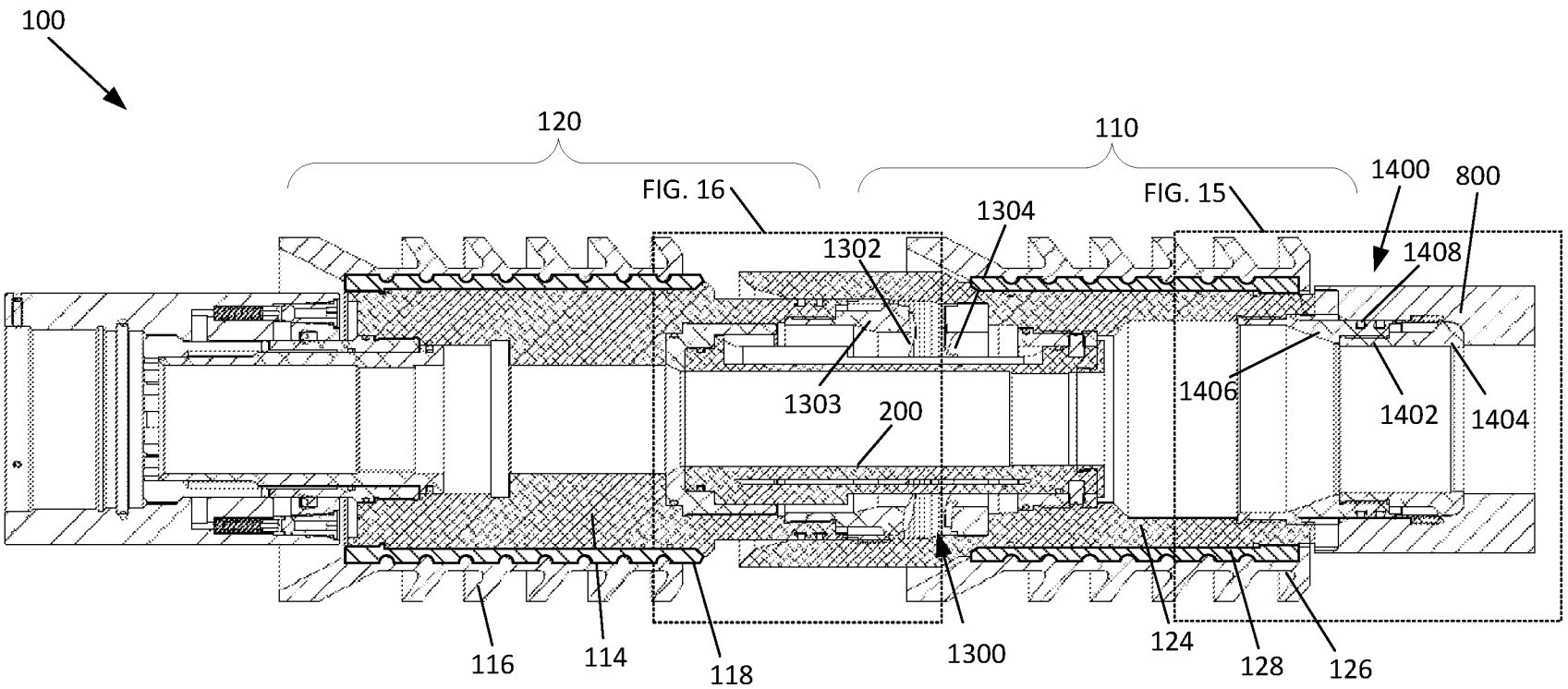
FIG. 14 illustrates a cross-sectional side view of the plug system, according to another embodiment.

FIG. 14 illustrates a cross-sectional side view of the plug system 100, according to another embodiment. This embodiment may be similar to the embodiment of FIG. 13, but may omit the second anti-rotation feature 1301 between the lower plug 110 and the float collar 800. In this embodiment, a first latching mechanism 1400 is provided instead, although, in other embodiments, both the second anti-rotation feature 1301 and the first latching mechanism 1400 may be included in the same embodiment, and thus these features should not be considered mutually exclusive to one another.

The first latching mechanism 1400 may include an insert 1402 that is connected to the float collar 800. In some embodiments, the insert 1402 may be formed from two pieces, e.g., a first piece 1404 and a second piece 1406. The first piece 1404 may be received into the inner bore of the float collar 800, as shown. The second piece 1406 may be coupled with, e.g., latched or threaded to, the inner bore of the body 124 of the lower plug 110. The second piece 1406 may extend downward from the lower plug 110 and the first piece 1404 may extend downward from the second piece 1406. Further, the second piece 1406 may include one or more seals 1408 that are configured to seal with the float collar 800.

Figure 15:
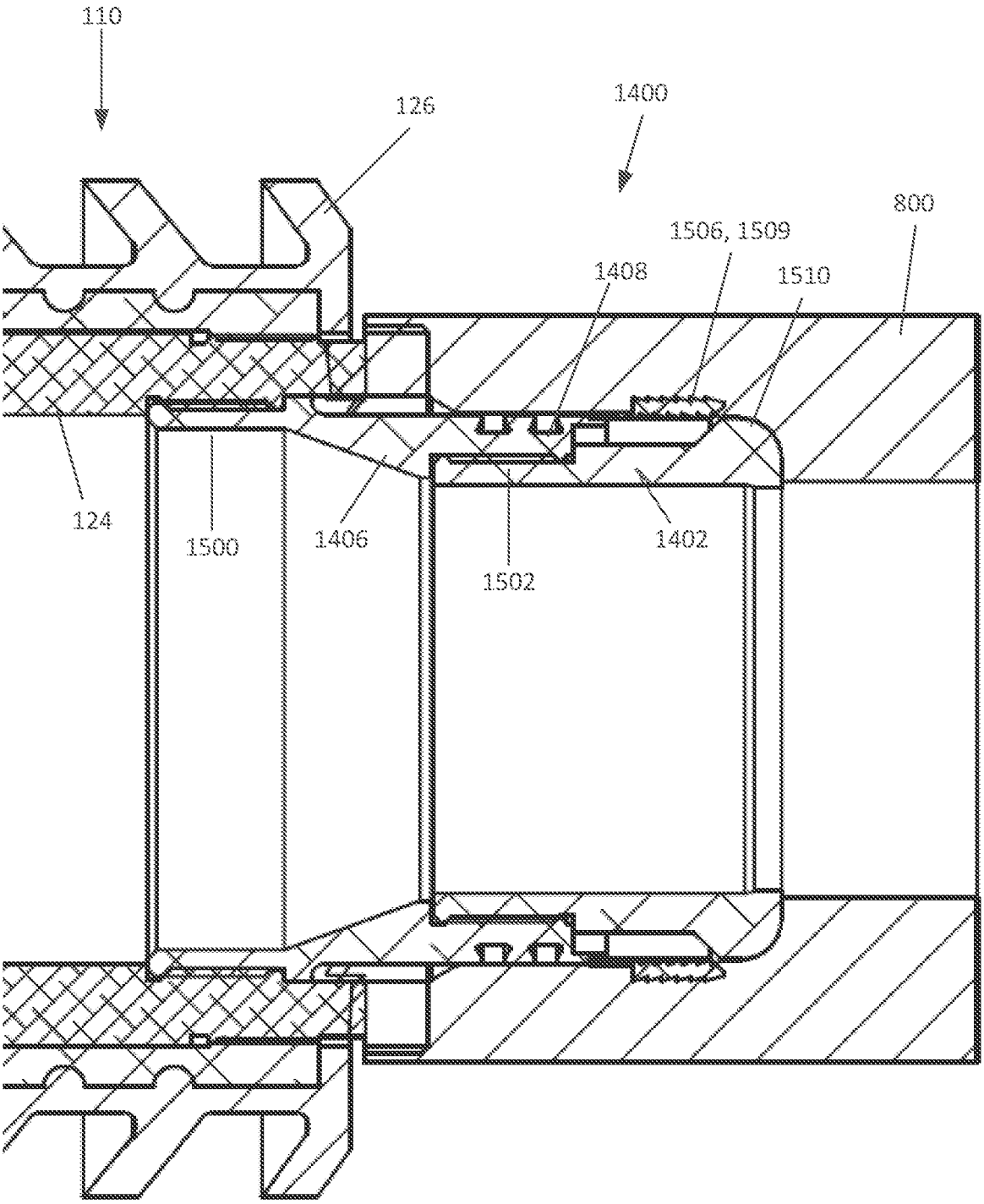
FIG. 15 illustrates an enlarged view of a portion of the plug system of FIG. 14, according to an embodiment.

Referring additionally to FIG. 15, the second piece 1406 may form a slidable connection 1500 with the body 124 of the bottom plug 110. Further, the second piece 1406 may form a slidable connection 1502 with the first piece 1404. The second piece 1406 may also include a lug 1506, which may be received into engagement with the float collar 800. The first piece 1404 may also include a shoulder 1510.

In operation, when the bottom plug 110 lands on the collar 800, the slidable connections 1500, 1502 may be compressed and retract, and the shoulder 1510 may force the lug 1506 radially outward, so as to latch into a groove or recess 1509 formed in the collar 800. The seals 1408 may seal with the float collar 800. Accordingly, the bottom plug 110 may seal with and be prevented from axial (upward) displacement from the float collar 800 by operation of the latching mechanism 1400.

Figure 16:
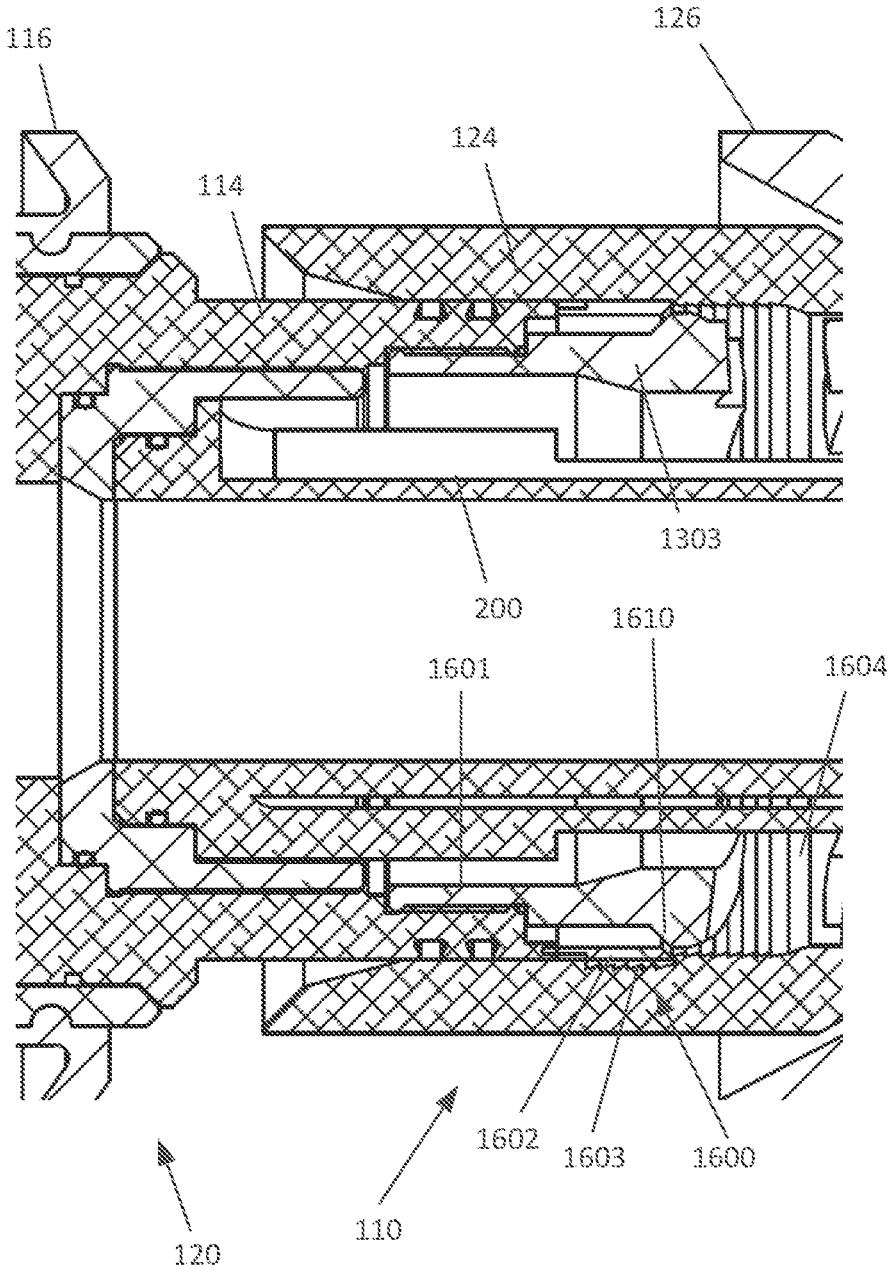
FIG. 16 illustrates an enlarged view of a portion of the plug system of FIG. 14, according to an embodiment.

Referring now to FIGS. 14 and 16, the plug system 100 may further include a second latching mechanism 1600 between the upper plug 120 and the lower plug 110. The second latching mechanism 1600 may operation in cooperation with the first anti-rotation feature 1300. For example, the second latching mechanism 1600 may include a latching member 1602 that is coupled to lower end of the top plug 110 via a slidable coupling 1601. The latching member 1602 may include a threaded outer profile 1603. The second latching mechanism 1600 may also include threads 1604 formed in the lower plug 110. Further, the second latching mechanism 1600 may include a shoulder 1605 provided by the extension body 1303, upon which the teeth 1302 are formed.

Accordingly, as the upper plug 120 lands on the lower plug 110, the extension body 1303 and the top plug 120 may be compressed together, such that the latching member 1602 is forced into contact with the shoulder 1610. The shoulder 1610 thus drives the latching member 1602 radially outwards, such that the threaded outer profile 1603 engages the threads 1604. As a consequence, the upper plug 110 resists axial (upward) displacement from the lower plug 110 via engagement between the threaded profile 1603 and the threads 1604. Thus embodiments are provided in which axial displacement of the upper plug 120 relative to the lower plug 110, or the lower plug 110 relative to the float collar 800, or both are prevented by one or more latching mechanisms.

As used herein, the terms "inner" and "outer"; "up" and "down"; "upper" and "lower"; "upward" and "downward"; "above" and "below"; "inward" and "outward"; "uphole" and "downhole"; and other like terms as used herein refer to relative positions to one another and are not intended to denote a particular direction or spatial orientation. The terms "couple," "coupled," "connect," "connection," "connected," "in connection with," and "connecting" refer to "in direct connection with" or "in connection with via one or more intermediate elements or members."

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. A plug system, comprising:

a lower plug;

an upper plug; and a sleeve configured to be positioned at least partially within the lower plug, the upper plug, or both, wherein:

the sleeve defines one or more channels in an outer surface thereof;

the sleeve also defines an outer shoulder on the outer surface thereof that is located closer to an upper end of the sleeve than to a lower end of the sleeve;

the sleeve is configured to shift axially from a first position into a second position with respect to the lower plug;

the outer shoulder is configured to contact an inner shoulder on the lower plug when the sleeve shifts to the second position;

in the first position, fluid is prevented from flowing through the one or more channels; and in the second position, the fluid is permitted to flow through the lower plug via the one or more channels.

2. The plug system of claim 1, further comprising:

one or more upper shear members that connect the sleeve to the upper plug, wherein the one or more upper shear members are configured to shear in response to a first predetermined force applied to the sleeve; and one or more lower shear members that connect the sleeve to the lower plug, wherein the one or more lower shear members are configured to shear in response to a second predetermined force applied to the sleeve.

3. The plug system of claim 2, wherein the first predetermined force is less than the second predetermined force such that the sleeve is configured to decouple from the upper plug in response to the first predetermined force, but not to decouple from the lower plug in response to the first predetermined force.

4. The plug system of claim 3, wherein the sleeve is configured to shift axially from the first position into the second position in response to the one or more lower shear members shearing.

5. The plug system of claim 1, wherein:

the lower plug comprises an inner surface through which the sleeve is at least partially received; and the sleeve comprises a lower seal, wherein the lower seal is configured to contact the inner surface of the lower plug and to prevent fluid flow between the lower plug and the sleeve when the sleeve is in the first position, and wherein the lower seal is configured to be spaced apart from the inner surface of the lower plug and to permit the fluid to flow through the one or more channels when the sleeve is in the second position.

6. The plug system of claim 5, wherein:

the upper plug comprises an inner surface through which the sleeve is at least partially received; and the sleeve comprises an upper seal, wherein the upper seal is configured to contact the inner surface of the upper plug and to prevent fluid flow between the upper plug and the sleeve when the sleeve is coupled to the upper plug, and wherein the one or more channels are positioned at least partially between the lower seal and the upper seal.

7. The plug system of claim 1, wherein the sleeve also comprises an inner surface having an inner shoulder, wherein the plug system further comprises a first impediment that is configured to be received on the inner shoulder of the sleeve.

8. The plug system of claim 7, wherein the sleeve is configured to decouple from the upper plug in response to a first predetermined force exerted on the first impediment and the sleeve, wherein the sleeve is configured to decouple from the lower plug and shift from the first position to the second position in response to a second predetermined force exerted on the first impediment and the sleeve, and wherein the first predetermined force is less than the second predetermined force.

9. The plug system of claim 1, wherein the lower plug, the upper plug, or both comprise:

a body having an inner surface that at least partially defines an axial bore through the plug system;

a sealing element positioned radially outward from the body, wherein an outer surface of the sealing element is configured to contact a tubular member in a well; and an adapter positioned at least partially between the body and the sealing element.

10. A plug system for performing a cementing operation in a well, the plug system comprising:

a lower plug;

an upper plug; and a sleeve coupled to the lower plug and the upper plug and received at least partially in both, wherein the sleeve defines one or more channels extending axially along an outer surface thereof, wherein the sleeve also defines an outer shoulder on the outer surface thereof that is located closer to an upper end of the sleeve than to a lower end of the sleeve, wherein the outer shoulder is defined in part by a lower surface, wherein the lower plug and the sleeve are configured to be separated from the upper plug in response to application of a first predetermined force to the sleeve, and wherein the sleeve is configured to shift axially with respect to the lower plug in response to application of a second predetermined force to the sleeve, from a first position in which fluid flow through the lower plug via the one or more channels is blocked to a second position in which fluid flow through the lower plug is permitted via the one or more channels, the first predetermined force being less than the second predetermined force.

11. The plug system of claim 10, wherein the sleeve comprises a lower seal positioned at least partially around the outer surface thereof, wherein the lower seal is configured to contact the lower plug to block fluid flow through the lower plug via the one or more channels when the sleeve is in the first position, and wherein the lower seal is spaced apart from the lower plug to permit fluid flow through the lower plug via the one or more channels when the sleeve is in the second position.

12. The plug system of claim 11, further comprising a first impediment that is configured to pass through the upper plug and be received at least partially within the sleeve, wherein the first and second predetermined forces are applied to the sleeve when the first impediment is received at least partially within the sleeve.

13. The plug system of claim 12, further comprising a second impediment that is configured to block fluid flow through the upper plug when the sleeve is in the second position, wherein the upper plug and the second impediment are configured to move toward the lower plug in response to application of a third predetermined force to the second impediment.

14. The plug system of claim 13, wherein the upper plug and the second impediment are configured to block fluid flow through the lower plug and the one or more channels after the upper plug and the second impediment move toward the lower plug.

15. The plug system of claim 10, further comprising at least one anti-rotation feature that prevents relative rotation of the upper plug relative to the lower plug, the lower plug relative to a float collar on which the lower plug has landed, or both.

16. The plug system of claim 10, further comprising at least one latching mechanism configured to resist axial displacement of the upper plug from the lower plug, the lower plug from a float collar on which the lower plug has landed, or both.

17. The plug system of claim 10, wherein the lower surface is positioned between an upper-most part and a lower-most part of the one or more channels to permit the fluid to flow into the one or more channels when the sleeve is in the second position.

18. A method for performing a cementing operation in a well, the method comprising:

running a lower plug, an upper plug, and a sleeve into a well;

introducing a first impediment into the well, wherein the first impediment passes through the upper plug and is received at least partially within the sleeve, and wherein the sleeve is positioned at least partially within the lower plug, the upper plug, or both;

separating the lower plug and the sleeve from the upper plug in response to application of a first predetermined force to the first impediment and the sleeve, wherein the sleeve is in a first position when the sleeve is separated from the upper plug, and wherein fluid flow through the lower plug via one or more channels in an outer surface of the sleeve is blocked when the sleeve is in the first position;

shifting the sleeve axially with respect to the lower plug from the first position to a second position in response to application of a second predetermined force to the first impediment and the sleeve, wherein the sleeve defines an outer shoulder on the outer surface thereof that contacts an inner surface of the lower plug when the sleeve shifts to the second position, wherein fluid flow through the lower plug via the one or more channels is permitted when the sleeve is in the second position, and wherein the first predetermined force is less than the second predetermined force; and pumping a cement slurry through the upper plug and the lower plug when the sleeve is in the second position, wherein the cement slurry flows through the lower plug via the one or more channels.

19. The method of claim 18, further comprising introducing a second impediment into the well, wherein the second impediment is received at least partially within a locking sleeve, and wherein the locking sleeve is positioned at least partially within the upper plug.

20. The method of claim 19, further comprising shifting the locking sleeve axially with respect to the upper plug from a locking position to an unlocking position in response to application of a third predetermined force on the second impediment and the locking sleeve.

21. The method of claim 20, wherein a latch collet is positioned at least partially between the locking sleeve and a coupling, wherein the latch collet is maintained in a radially outward position by the locking sleeve when the locking sleeve is in the locking position, and wherein the latch collet couples the upper plug to the coupling when in the radially outward position.

22. The method of claim 21, further comprising:

actuating the latch collet into a radially inward position in response to the locking sleeve shifting to the unlocking position; and separating the upper plug, the locking sleeve, and the latch collet from the coupling in response to the latch collet actuating into the radially inward position.

* * * * *